United States Patent [19]

Werner et al.

[11] 4,415,295

[45] Nov. 15, 1983

[54] MINERAL MINING INSTALLATIONS

[75] Inventors: Georg Werner; Paul Wisniewski, both of Lunen, Fed. Rep. of Germany

[73] Assignee: Gewerkschaft Eisenhütte Westfalia, Lunen, Fed. Rep. of Germany

[21] Appl. No.: 331,997

[22] Filed: Dec. 18, 1981

[30] Foreign Application Priority Data

Dec. 30, 1980 [ZA] South Africa ..... 80/8106

[51] Int. Cl.[3] ..... E21D 23/00

[52] U.S. Cl. ..... 405/291; 405/296

[58] Field of Search ..... 405/291, 294, 295, 296; 299/12, 13

[56] References Cited

U.S. PATENT DOCUMENTS

| | | | |
|---|---|---|---|
| 1,386,622 | 8/1921 | Huguenin | 299/13 |
| 3,623,771 | 11/1971 | Sosnowicz | 299/13 X |
| 3,638,754 | 2/1972 | Sosnowicz et al. | 299/13 X |
| 3,889,475 | 6/1975 | Allen | 405/296 X |

FOREIGN PATENT DOCUMENTS

| | | | |
|---|---|---|---|
| 2509801 | 9/1976 | Fed. Rep. of Germany | 405/291 |

*Primary Examiner*—Dennis L. Taylor

*Attorney, Agent, or Firm*—Charles E. Pfund

[57] ABSTRACT

A mineral mining installation serves to win mineral by explosive blasting. The installation employs a shuttle conveyor arranged alongside a mineral face. Roof supports stand side-by-side at the side of the conveyor remote from the conveyor. The roof supports are connected to the conveyor through shifting rams and have roof-engageable caps or the like supported on hydraulic props. The pans of the conveyor have upstanding walls at the rear side nearest the roof supports which carry rails at their upper ends. The roof caps have wall components pivoted thereto and hydraulic piston and cylinder units serve to swing the wall components up and down. When explosive blasting takes place the wall components are swung down to engage on the walls of the conveyor pans to form a screen between the winning region and the access region of the working.

12 Claims, 5 Drawing Figures

MINERAL MINING INSTALLATIONS

BACKGROUND TO THE INVENTION

The present invention relates to a mineral mining installation which serves to win mineral by explosive blasting.

In underground mine workings where mineral ore is won by blasting it is known to arrange a continuous protective screen wall on a conveyor. The screen wall can be composed of individual wall sections formed by resiliently supported lower and upper wall parts which can be selectively raised and lowered by means of hydraulic units. Such a construction is described in German Patent Specification No. 2 509 801. The screen wall can be erected to close off the conveying and winning region, where the blasting takes place, from the rear access region. During blasting, the wall acts to protect the access region from the effects of the blasting and ensures no high grade mineral ore becomes lost. After blasting, the wall can be collapsed to permit the loose material to be transported away by the conveyor. Another type of screen wall, described in German Patent Specification No. 2 558 884, employs wall parts hinged to the pans of the conveyor. These wall parts can be set up against the roof and supported by hydraulic units.

In general, the known screen walls hinder the access to the winning and conveying region and are relatively expensive and prone to damage. A general object of the present invention is to provide an improved form of mineral mining installation of the type described hereinbefore.

SUMMARY OF THE INVENTION

In its broadest aspect the present invention provides a mineral winning installation for winning mineral by explosive blasting, said installation comprising a shuttle conveyor alongside a mineral face, a roof support system arranged at the side of the conveyor remote from the conveyor and wall components pivotably carried by roof-engageable structures of the roof support system and capable of being swung down to depend from the roof-engageable structures to form a screen between the winning and conveyor region and the access region of the working.

An installation constructed in accordance with the invention comprises a conveyor extending alongside a mineral face, roof supports disposed alongside the conveyor remote from the mineral face, said roof supports having roof-engageable structures supported by hydraulic props, hydraulic shifting rams operably connected between the conveyor and the supports and means for selectively screening off the winning and conveying region of the working from the access region, wherein the screening means includes wall components pivotably connected to the roof-engageable structures of the supports and capable of adopting an operating position depending from the roof-engageable structures or an inoperative stowed position. Piston and cylinder units can serve to swing the wall components up and down. An abutment is preferably provided on the conveyor against which the wall components engage when they are swung down into the operative position. The abutment can be formed as further wall components with rails at their upper ends. The rails can serve to support drilling equipment used to set the explosive charges into the mineral face.

With the wall components set in their stowed inoperative position they can perform a supportive function assisting to support the roof. It is preferable to provide the roof-engageable structures of the roof supports with advance linings which project towards the mineral face. The wall components can then engage on the underside of the advance linings when set in their stowed inoperative position. The advance linings can be plug-in leaf springs which support the roof over the conveyor during the blasting operation. With the wall components in their stowed inoperative position the winning and conveying region of the working is freely open to the access region where the roof supports are located.

To reliably secure the access area behind the conveyor, where personnel are sited, it is desirable to have the roof supports set close together so that their roor-engageable structures combine to form a more-or-less continuous canopy pressed against the roof.

To enable the installation to cope with seams of different heights it is desirable to make the wall components and/or the abutment-forming means adjustable in height, for example as described hereinafter.

The conveyor is preferably a shuttle conveyor able to withstand the forces occurring in the explosive blasting operation. The conveyor is then composed of individual pans arranged end-to-end and entrainment devices which are oscillated to and fro along the pans. The pans are preferably of rigid stout construction interconnected by connection means allowing relative angular displacements. One form of connection means comprises toggle members seating in open pockets at the ends of the pans.

The invention may be understood more readily, and various other aspects and features of the invention, may become apparent from consideration of the following description.

BRIEF DESCRIPTION OF THE DRAWINGS

An embodiment of the invention will now be described, by way of example only, with reference to the accompanying drawings, wherein.

DESCRIPTION OF PREFERRED EMBODIMENT

Figure 1:
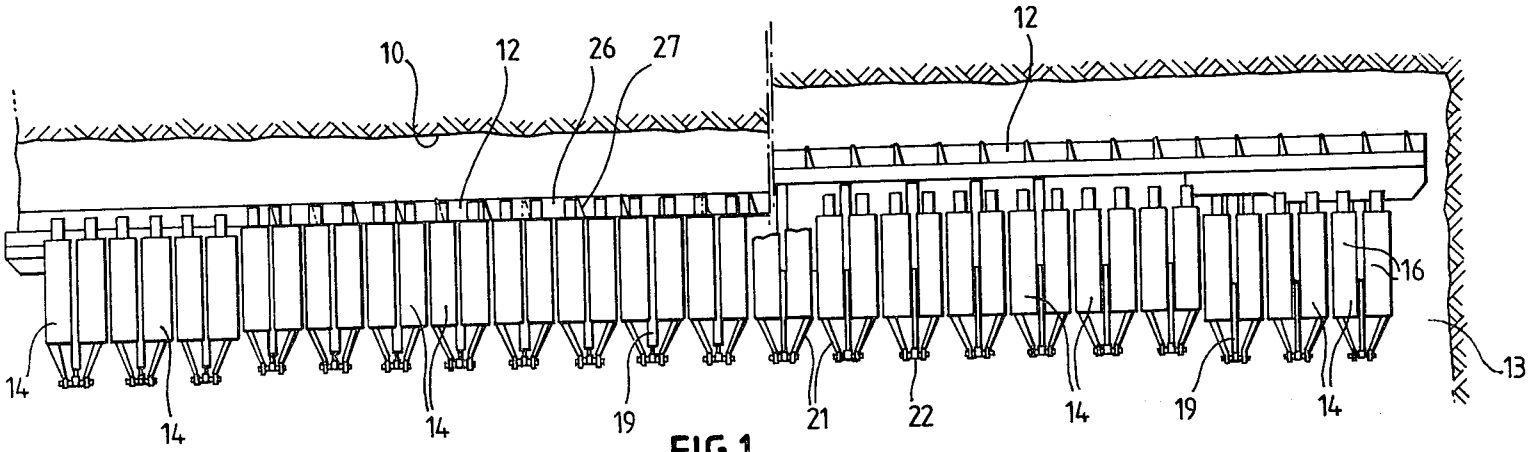
FIG. 1 is a diagrammatic plan view of a mineral mining installation constructed in accordance with the invention.
Figure 2:
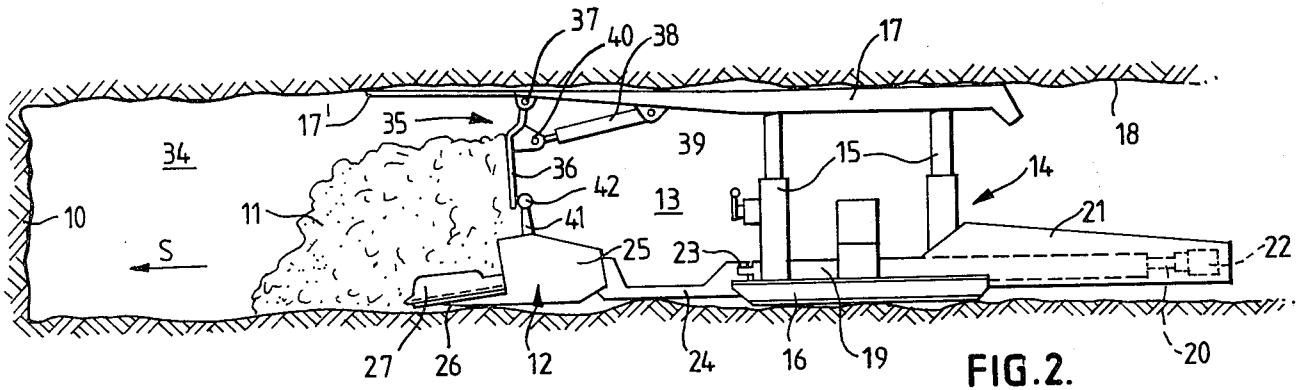
FIG. 2 is an end view of the installation shown in FIG. 1.
Figure 3:
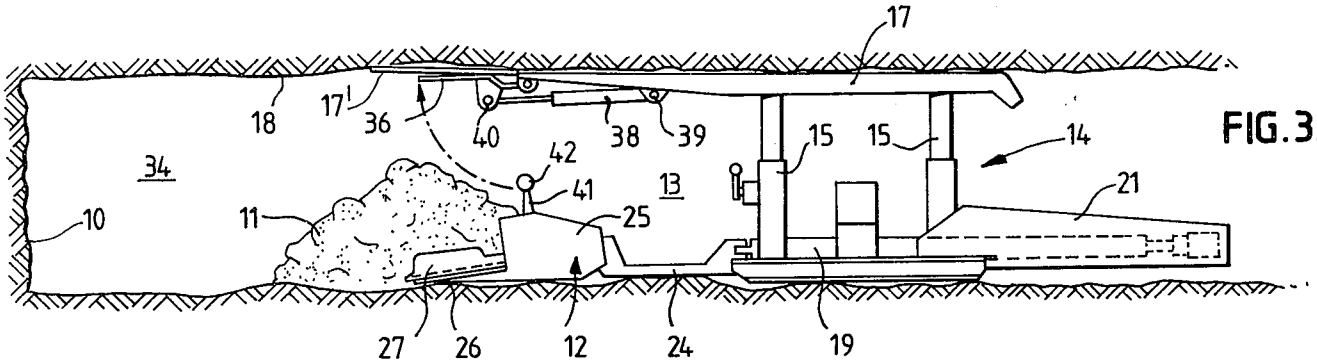
FIG. 3 is a view of the installation corresponding to FIG. 2 but depicting parts thereof in a different operating position.

As shown in FIGS. 1 to 3, a mineral mining or winning installation serves to win mineral, especially valuable ores such as gold, from a mineral face 10. The mineral is detached from the face 10 by explosive blasting and the detached loose material 11 is transported away by a conveyor 12. The conveyor 12 can be of any suitable type and is constructed from a series of individual pans 25 arranged end-to-end and along which the material is transferred. The conveyor 12 is preferably a so-called shuttle conveyor with entrainment devices or scrapers oscillated to-and-fro above a bed formed by the pans 25. Examples of suitable shuttle conveyors are described in German Patent Specification No.

2 558 884 which has a counterpart in the U.S. Pat. No. 4,241,824.

In the access region 13 of the working at the side of the conveyor 12 remote from the mineral face 10 there is a hydraulic walking roof support system. This system is composed of individual supports 14 in side-by-side relationship. Each support 14, has four hydraulic props 15 in rectangular configuration supported on a slidable floor-engageable structure, such as a single or multi-part sill, or girder 16. A roof-engageable structure 17, such as a single or multi-part cap or girder is carried by the props 15. Extension of the props 15 causes the structure 17 to be urged against the roof 18. The individual supports 14 are positioned to stand closely adjacent one another so that when braced their roof caps 17 form a more-or-less continuous canopy in contact with the roof 18. Each support 14 has a hydraulic shifting ram 19 linked to the conveyor 12. More particularly, the rams 19 have piston rods 20 attached with pivot joints 22 to rear extension components 21 of the floor sills 16. The cylinders of the rams 19 are similarly connected with pivot joints 23 to coupling members 24 which are articulatedly connected to the individual pans 25 of the conveyor 12. The coupling members 24 may take the form of substantially flat trough-like components known per se. By extending the rams 19, the conveyor 12 can be shifted in the direction of arrow S in FIG. 2 towards the mineral face 10. Normally the conveyor 12 would be advanced towards the face 10 in sections. FIG. 1 depicts the situation where a region of the conveyor 12 at the right-hand side of the FIG. has been advanced while a region of the conveyor 12 at the left-hand side of the Figure has not yet been advanced. Once the conveyor 12 has been advanced overall in this manner the individual supports 14 can be drawn up to follow the winning progress. This would involve relief of the props 15 of the unit 14 which is to be shifted and retraction of the associated ram 19. The supports 14 would be drawn up one-by-one in sequence and as the winning progresses the advancement of the conveyor 12 and shifting up of the supports 14 would be repeated as known per se.

Figure 5:
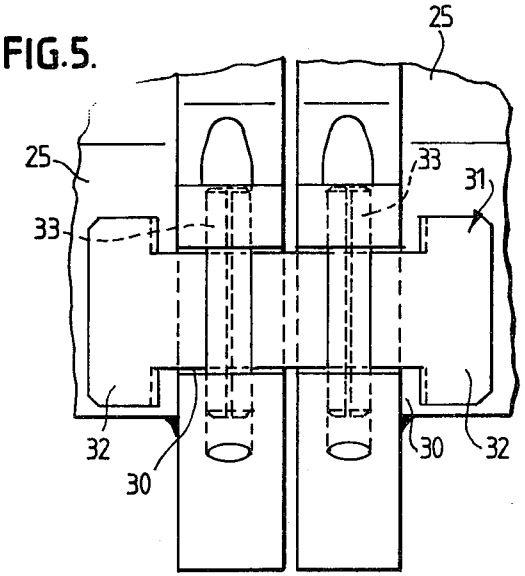
FIG. 5 is a plan view of part of the conveyor showing the connection between the individual pans thereof.
Figure 4:
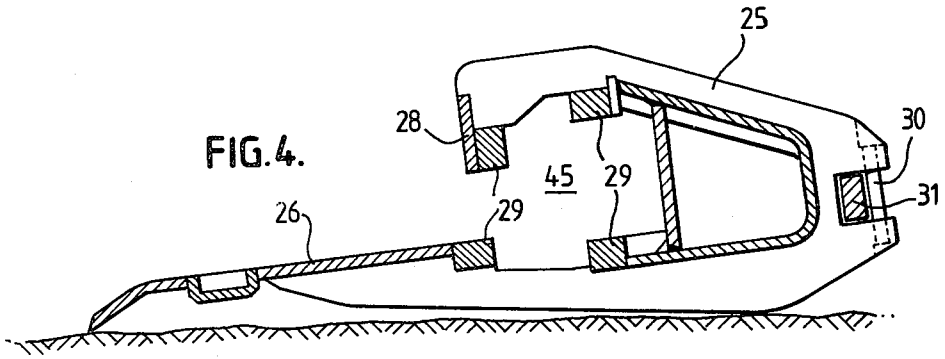
FIG. 4 is a cross-sectional view of the conveyor of the installation, the view being taken on a somewhat larger scale.

FIG. 4 and 5 depict in greater detail the construction of the conveyor pans 25. Each pan 25 has an angular profile with a floor surface 26 forming part of the bed along which the material is transferred by the scrapers 27. As is known, the scrapers 27 are pivotably connected to a common traction means (not shown). The traction means is preferably a jointed beam composed of guide blocks guided within a guide channel 45 located behind a face wall 28, of each of the pans 25. Guide strips 29, which are easily replaceable, are provided in the channel 45 to contact the traction means. The traction means is preferably driven at both ends of the conveyor 12 to reciprocate back and forth parallel to the longitudinal direction of the conveyor 12. As is known during movement of the traction means in one direction, the scrapers 27 adopt a working position more or less perpendicular to the direction of motion of the traction means thereby entraining the material collected on the floors 26 of the pans 25 and forcing the material in the conveying direction. When the traction means reverses its direction of movement the scrapers 27 automatically pivot inwards towards the face walls 28 and do not cause any significant movement of material. The material thus progresses along the conveyor in a series of intermittent steps. The pans 25 are connected together with connections which permit angular mobility therebetween. The pans 25 have open pockets 30 at the ends open towards the supports 14 and receiving shaped toggle members 31 each composed of a central shank between enlarged heads 32. The combination of the toggle members 31 within the pockets 30 form connections between the pans 25 which resist traction forces while permitting canting. To retain the toggle members 31 in the sockets 30 detachable locking elements such as pins 33, are introduced through aligned bores in the pans 25 to overlap the pockets 30.

Screening means 35 serves to seal off the main winning region 34 of the working selectively from the access region 13 when blasting takes place. This screening means 35 is composed of individual wall components 36 which are pivotably connected with pivot joints 37 to the forward end regions of the roof-engageable structures 17 of the supports 14. Hydraulic piston and cylinder units 38 are pivotally connected between the wall components 36 and the roof-engageable structures 17. The cylinders of the units 38 are connected with pivot joints 39 on the undersides of the roof-engageable structures 17 while the piston rods of the units 38 are connected with pivot joints 40 to the rear sides of the wall components 26. These units 38 thus serve to adjust the position of the wall components 36 between an inoperative position stowed near the roof 18 as shown in FIG. 3, and an upstanding operative position as shown in FIG. 2. The roof engageable structures 17 are provided with advance lining or girders 17' in the form of plug-in leaf springs. The girders 17' project forwardly towards the mineral face 10 to support the region of the roof 18 above the conveyor 12 and the wall components 36 engage on the girders 17' when they are pivoted upwards into their inoperative position, (FIG. 3) to assist in the roof supporting function.

The individual pans 25 of the conveyor 12 are provided with upwardly extending wall components 41 having support rails 42 of tubular form at their upper ends. The wall components 41 and the support rails 42 form abutments against which the pivotable wall components 36 engage when they are pivoted downwardly into their operative position (FIG. 2). When the wall components 36 are pivoted downwards into their operative position they combine with the wall components 41, and their support rails 42, to form the screening means 35 to screen off the winning region 34 from the access region 13 over the centre height and length of the working. When the screening means 35 is inoperative and the wall components 36 are stowed away, the support rails 42 can be used to support drilling equipment.

It is desirable to make the screening means 35 adjustable in height to cope with different seam thickness and this can be accomplished by making the wall components 36 and/or the wall components 41 variable in the effective height dimension. For example, the wall components 41 can be extended upwardly by fixing detachable extension pieces or by making the components 41 from slidable or pivotable parts.

During use, the wall components 36 are swung downwardly into the operative position to complete the screening means 35 as shown in FIG. 2. In this position the roof is supported above the conveyor 12 solely by the advance lining girders 17'. The mineral face 10 is then subjected to explosive blasting and the detached material is confined in the winning region 34 by the presence of the screening means 35. After blasting has been completed, the wall components 36 are pivoted upwardly into the stowed position as shown in FIG. 3 and the loose material is transported away by means of the conveyor 12. The conveyor 12 is progressively shifted up towards the face 10 by the rams 19 as the material is removed as described previously. Once sufficient loose material has been removed, the conveyor 12 is drawn back away from the face 10 temporarily to permit drilling of the holes for in the face 10 the next batch of explosive charges. The supports 14 are drawn up to the face 10 either before or after the drilling operation. The wall components 36 are then lowered again for blasting to take place and the sequence is repeated.

We claim:

1. In a mineral mining installation suitable for winning material by explosive blasting; said installation comprising a conveyor extending alongside a mineral face, roof supports disposed alongside the conveyor remote from the mineral face, said roof supports having roof-engageable structures supported by hydraulic props, hydraulic shifting rams operably connected between the conveyor and the supports and means for selectively screening off the winning and conveying region of the working from the access region; the improvement comprising the screening means includes wall components pivotably connected to the roof-engageable structures of the supports and capable of adopting an operating position depending from the roof-engageable structures or an inoperative stowed position and the conveyor has further wall components forming part of the screening means and acting as an abutment against which the wall components engage when set in their operating position.

2. In a mineral mining installation suitable for winning mineral by explosive blasting; said installation comprising a conveyor extending alongside a mineral face, roof supports disposed alongside the conveyor remote from the mineral face, said roof supports having roof-engageable structures supported by hydraulic props, hydraulic shifting rams operably connected between the conveyor and the supports and means for selectively screening off the winning and conveying region of the working from the access region; the improvement comprising the screening means includes wall components pivotably connected to the roof-engageable structures of the supports and capable of adopting an operating position depending from the roof-engageable structures or an inoperative stowed position and the conveyor has an abutment-forming means against which the wall components engage when set in their operating position.

3. An installation according to claim 2, wherein hydraulic piston and cylinder units are connected between the wall components and the roof-engageable structures of the supports and the units serve to move the wall components between their operative an inoperative positions.

4. An installation according to claim 2, wherein the roof-engageable structures of the supports combine to form a more-or-less continuous canopy for contact with the roof of the working, the roof-engageable structure of each support is provided with an advance lining projecting forwardly towards the mineral face and the wall components engage on the advance linings when set in their inoperative position.

5. An installation according to claim 2, wherein the conveyor is a shuttle conveyor composed of individual pans arranged end-to-end, the pans each have pockets at their end regions open towards the supports, the pockets serving to receive toggle members which have heads with reduced shanks therebetween and the toggle members locate in the pockets in a manner to resist tractive force while permitting limited angular movement between the pans.

6. An installation according to claim 2, wherein the abutment-forming means has an adjustable height.

7. An installation according to claim 1, wherein the wall components have an adjustable effective height.

8. An installation according to claim 2, wherein the abutment-forming means at least includes a rail which serves as a support for drilling equipment when the wall components are set in the inoperative stowed position.

9. An installation according to claim 1, wherein the further wall components have rails at their upper ends which serve as a support for drilling equipment when the wall components are set in the inoperative stowed position.

10. An installation according to claim 1, wherein hydraulic piston and cylinder units are connected between the wall components and the roof-engageable structures of the supports and the units serve to move the wall components between their operative and inoperative positions.

11. An installation according to claim 1, wherein the roof-engageable structures of the supports combine to form a more-or-less continuous canopy for contact with the roof of the working, the roof-engageable structure of each support is provided with an advance lining projecting forwardly towards the mineral face and the wall components engage on the advance linings when set in their inoperative position.

12. An installation according to claim 1, wherein the conveyor is a shuttle conveyor composed of individual pans arranged end-to-end, the pans each have pockets at their end regions open towards the supports, the pockets serving to receive toggle members which have heads with reduced shanks therebetween and the toggle members locate in the pockets in a manner to resist tractive force while permitting limited angular movement between the pans.

* * * * *